US008650685B1

(12) United States Patent
Ford

(10) Patent No.: US 8,650,685 B1
(45) Date of Patent: Feb. 18, 2014

(54) SUPPORTIVE BABY BLANKET

(76) Inventor: Brooke L. Ford, SeaTac, WA (US)

( * ) Notice: Subject to any disclaimer, the term of this patent is extended or adjusted under 35 U.S.C. 154(b) by 180 days.

(21) Appl. No.: 13/273,138

(22) Filed: Oct. 13, 2011

(51) Int. Cl.
*B68G 5/00* (2006.01)

(52) U.S. Cl.
USPC ..... 5/655; 5/494; 2/69

(58) Field of Classification Search
USPC ..... 5/655, 494, 658, 485, 482, 413 R, 923, 5/922; 2/69, 69.5
See application file for complete search history.

(56) References Cited

U.S. PATENT DOCUMENTS

2011/0083276 A1* 4/2011 Pieta et al. ..... 5/655

* cited by examiner

*Primary Examiner* — Peter M Cuomo
*Assistant Examiner* — Brittany Wilson
(74) *Attorney, Agent, or Firm* — Patrick J. S. Inouye; Krista A. Wittman

(57) ABSTRACT

A supportive baby blanket is provided. The supportive baby blanket includes a square shaped blanket, a support board, and a sleeve. The blanket is folded at one corner to form a pocket. The support board is made from a firm material that is shaped to fit within the pocket of the blanket. The sleeve is shaped to conformably surround the support board prior to insertion into the pocket.

16 Claims, 8 Drawing Sheets

10

40

60

SUPPORTIVE BABY BLANKET

FIELD

The invention relates in general to baby blankets, and in particular, to a supportive baby blanket.

BACKGROUND

Caring for a newborn baby can be exciting, as well as stressful, especially in the first few months of a baby's life. Babies require lots of attention, as well as physical and support, which can be overwhelming and challenging, especially to first time parents and caretakers. Due to the fact that an infant's head is extremely large and heavy in relation to the rest of their body and an underdeveloped muscular structure, infants are not able to securely hold their own head up until about four months old and prior to that time, rely on their caretaker to do so for them. For instance, the caretaker must always ensure that the baby's head, neck, and back are supported and protected when performing activities, such as holding the baby, swaddling the baby, changing diapers, breast feeding, burping the baby, and bathing the baby.

New parents, other adults, or children may be uncomfortable holding or carrying a newborn baby due to their size and inability to support their head, neck, and back. Holding and carrying a baby normally requires two hands to ensure that the baby's head, neck, and back are properly supported. When both hands are used, other tasks or activities can be difficult to perform, such as preparing a bottle, attending to other children, answering the phone or door, as well as other activities.

Newborn babies usually feel most comfortable and secure when tightly wrapped or swaddled in a blanket. However, conventional blankets fail to provide any support for a baby and the individual holding the baby is still responsible for ensuring the baby's head is supported.

Accordingly, there remains a need for providing a supportive baby blanket to protect a baby's head, neck, and back during infancy.

SUMMARY

This supportive baby blanket system includes a blanket, support board, and padded sleeve. The baby blanket can be shaped as a square and folded over at one corner. A substantially rectangularly shaped pocket is formed within the blanket at the folded corner to receive the support board and padded sleeve. The support board is sized to extend from the top of a baby's head, past the baby's hips. The sleeve is shaped to conformably surround the support board prior to insertion into the blanket pocket. The sleeve provides cushioning for the baby when placed over the support board. After positioning the baby on the support board in the blanket, the remaining blanket can be used to swaddle the baby by folding one side across the baby, folding the end over the baby's legs, and by folding the other side across the baby.

An embodiment provides a supportive baby blanket. The supportive baby blanket includes a square shaped blanket, a support board, and a sleeve. The blanket is folded at one corner to form a pocket. The support board is made from a firm material that is shaped to fit within the pocket of the blanket. The sleeve is shaped to conformably surround the support board prior to insertion into the pocket.

A further embodiment provides a method for constructing a supportive baby blanket. A sleeve having a U-shape is formed and includes an opening on one end. A support board is made from a firm material and inserted into the sleeve via the opening. A pocket is formed within a blanket. To form the pocket, one corner end of the blanket is folded over a top surface of the blanket. The corner end is affixed to the top surface via two parallel seams that each extend from the fold to sides of the corner end. The pocket is formed between the two parallel seams with a pocket opening located opposite the fold and is sized to receive the sleeve and the support board.

Still other embodiments will become readily apparent to those skilled in the art from the following detailed description, wherein are described embodiments by way of illustrating the best mode contemplated. As will be realized, other and different embodiments are possible and their several details are capable of modifications in various obvious respects, all without departing from the spirit and the scope. Accordingly, the drawings and detailed description are to be regarded as illustrative in nature and not as restrictive.

DETAILED DESCRIPTION

Newborn babies are unable to hold their own heads until they reach the age of about four months old. Prior to that time, babies rely on caretakers to support their heads, necks, and backs while being carried or lifted. Generally, the caretakers support the baby by resting the baby's head against the caretaker's arm or chest. Often, both hands are required to ensure that the baby is fully supported, which makes multi-taking difficult. A supportive blanket provides additional support to the baby's head, neck, and back, which may allow the caretaker to perform other tasks, while still supporting or carrying the baby.

Figure 1:
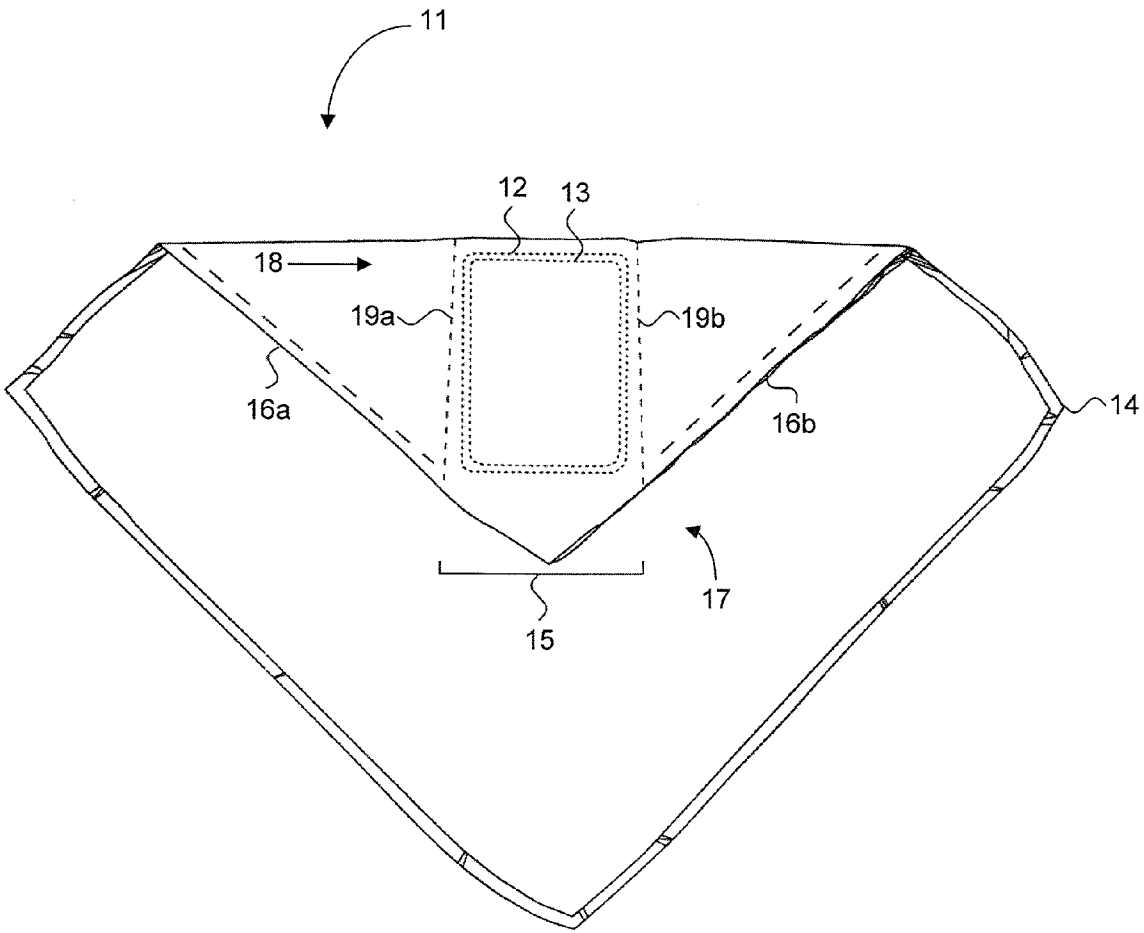
FIG. 1 is a top view showing a supportive baby blanket, in accordance with one embodiment.

The baby can be placed in the supportive blanket to facilitate ease of supporting, swaddling, carrying, lifting, and passing the baby. FIG. 1 is a top view 10 showing a supportive baby blanket 11, in accordance with one embodiment. The supportive baby blanket includes a cloth blanket 14, support board 13, and sleeve 12. The cloth blanket 14 can be made from materials, including cotton, felt, fleece, and microfiber, as well as other types of material. The cloth blanket 14, support board 13, and sleeve 12 can be removably affixed to allow for cleaning and sanitation of the individual pieces. In a further embodiment, one or more of the pieces can be permanently affixed. For example, the sleeve 12 can be permanently affixed within a pocket of the blanket 14.

The cloth blanket 14 can have a substantially square or rectangular shape with four corner ends 17. Each corner end 17 of the cloth blanket 14 includes a corner 15 and two straight side edges 16*a-b* that each extend from one end of the corner 15. The corners can form a right angle or can be rounded. A top corner end 17, located at a top of the cloth blanket 14, can be folded over a top surface of the blanket to form a triangle and can be partially affixed. Specifically, the top corner end 17 can be affixed along the straight edge sides 16*a-b* of the triangle via thread, glue, adhesive tape, or other types of adhesive, leaving the top corner 15 of the cloth blanket unaffixed, which can create an opening between the folded rounded end 17 and the top surface of the cloth blanket. Once folded, the top end of the cloth blanket forms a straight edge.

The folded top corner end 17 can be further affixed to the top surface of the cloth blanket 14 to form a pocket 18 to receive the support board 13 and sleeve 12. Two substantially parallel seams 19*a-b* extend from an outer edge of the corner 15 and extend upward to the straight edge of the folded cloth blanket to affix the folded top corner end 17 to the cloth blanket to form the pocket, which has a substantially rectangular shape. Other shapes are possible. A size of the pocket 18 is dependent on a size of the support board 13 and sleeve 12. The seams 19*a-b* can include thread, which is stitched, glue, adhesive tape, or other types of adhesive. Since the corner 15 is not affixed to the top surface of the cloth blanket 14, an opening is formed to provide access to the pocket 18.

Figure 2:
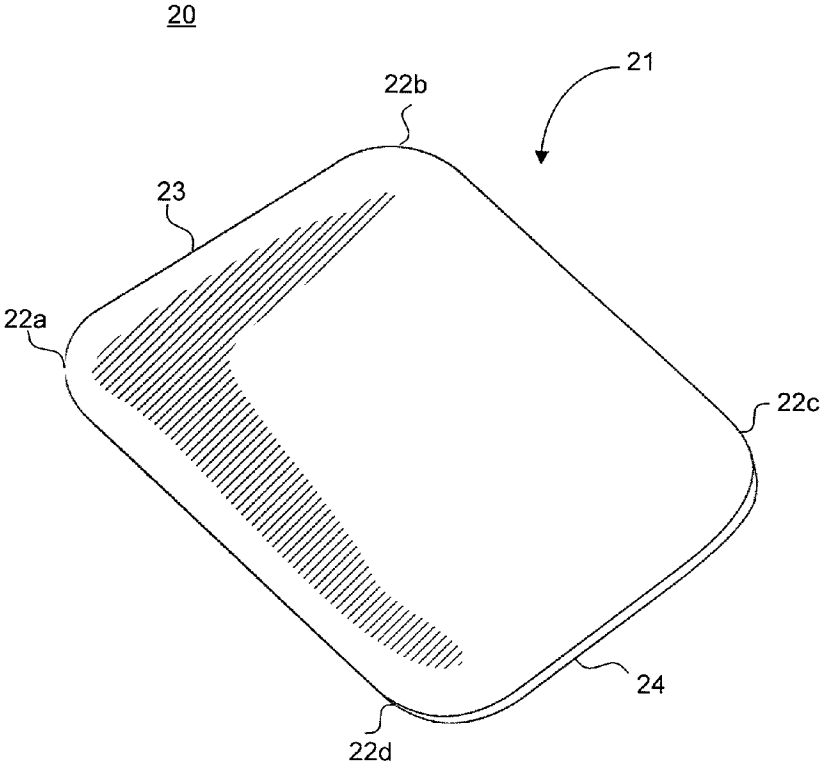
FIG. 2 is a top view showing, by way of example, a support board.

The support board can be inserted into the pocket of the cloth blanket to provide support for a baby. FIG. 2 is a perspective view 20 showing, by way of example, a support board 21. The support board 21 can have a square or rectangular shape with four rounded corners 22*a-d*, two along a top end 23 and two along a bottom end 24. Other shapes and configurations for the support board are possible, such as two rounded corners. The support board 21 can be made from material including plastic or polyethylene, as well as other types of material. At a minimum, the material used for the support board should be heavy enough to support a baby, while flexible enough to bend with the baby's weight to loosely conform to the baby. Additionally, the material should be hypoallergenic to prevent triggering any allergies the baby may have. Further, a size of the support board should be large enough to support a newborn baby up until about four months old. Specifically, to support the baby, the support board should be sized to ensure that the baby's head, neck, and back is supported. For example, the support board can have dimensions of 9 inches wide by 14 inches long, which would provide support for most newborn babies. Other dimensions are possible.

In a further embodiment, different sized support boards can be used based on the baby's size. For example, the support board can be provided in different sizes to accommodate, for instance, a premature baby, a newborn baby, and an older baby, such as two months or older. At a minimum, the support board should be long enough to support a baby's head, neck, and back. Specifically, the board should be long enough to span a distance measured from a top of the baby's head to the baby's hips. Additionally, the support board should be wide enough to support a width of the baby.

Figure 3:
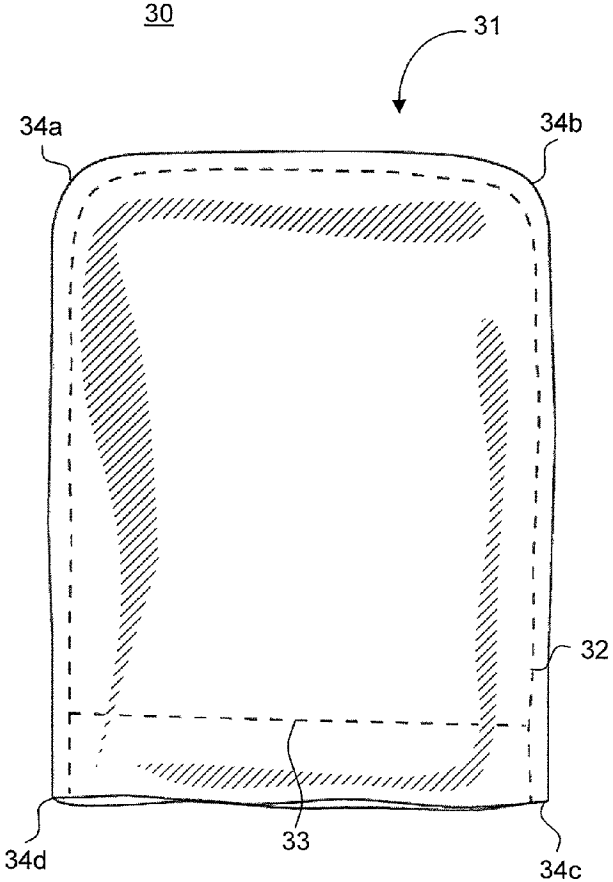
FIG. 3 is a top view showing, by way of example, a sleeve for the support board of FIG. 2.

Prior to inserting the support board into the pocket of the cloth blanket, the support board is positioned within a sleeve. FIG. 3 is a top view 30 showing, by way of example, a sleeve 31 for the support board of FIG. 2. The sleeve 31 is shaped to conformably surround the support board described above with reference to FIG. 2. In one embodiment, the sleeve 31 can have a rectangular shape with four corners 34*a-d*. A bottom of the sleeve includes an opening to insert the support board. The sleeve 31 should be large enough to fit over and around the entire support board and can be made from material, such as cotton, felt, fleece, or microfiber, as well as other types of material that provide padding to the support board. A security flap, positioned on the bottom of the sleeve 31, can cover the opening to prevent the support board from moving or falling out of the sleeve.

The sleeve 31 can be made from a single piece of material or multiple pieces of material. To construct the sleeve 31, a front piece of material can be affixed to a back piece of material via thread, glue, adhesive tape, or other types of adhesive on at least two edges. For instance, when one piece of material is used, two edges are affixed. For example, a piece of material can be folded on one side, left or right, and affixed at a top side and the remaining left or right side. In a further example, a piece of material can be folded at the top and affixed along the left and right sides. Also, the piece of the material can be folded at the top, such that the top side extends further than the back side or the back side extends further than the top side. The extension can then be folded over the opening at the bottom and affixed to the opposite side to form a security flap 33. Meanwhile, if two separate pieces of material are used, the pieces are affixed on three sides, including the top, left, and right sides. An opening is positioned at the bottom end, between the front and back sides, to receive the support board. In one embodiment, a security flap 33 is formed on one side, such as the front or back side, as material extending from the bottom end beyond the bottom end of other side. The extended flap is then positioned over the opening and affixed to a top surface of the other side to prevent the support board, when inserted, from moving or falling out of the sleeve. In a further embodiment, the security flap can be affixed to an inside surface of the other side.

Figure 4:
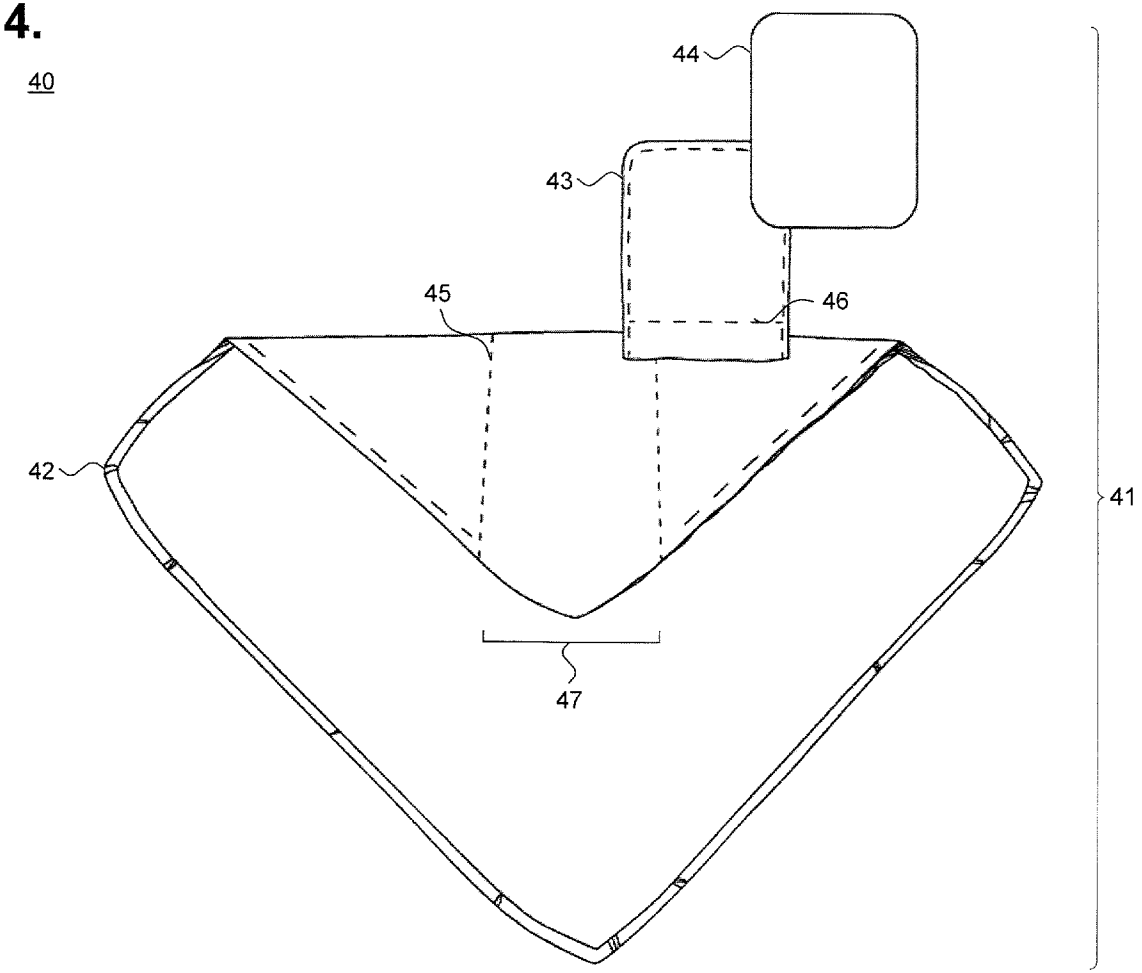
FIG. 4 is an exploded view of the supportive baby blanket of FIG. 1.

Together, the cloth blanket, support board, and sleeve are arranged as the supportive baby blanket. FIG. 4 is an exploded view 40 of the supportive baby blanket 41 of FIG. 1. The supportive baby blanket 41 includes a cloth blanket 42, sleeve 43, and support board 44. The support board 44 is removably placed into the sleeve 43 to provide additional cushioning for the baby once positioned on the supportive blanket 41. A security flap 46 affixed to the sleeve 43 is positioned over a bottom end of the support board 44 to ensure the support board 44 remains in the sleeve 43. Together, the support board 44 and sleeve 43 are placed into a pocket 45 formed within the cloth blanket 42 via an opening 47.

Figure 5:
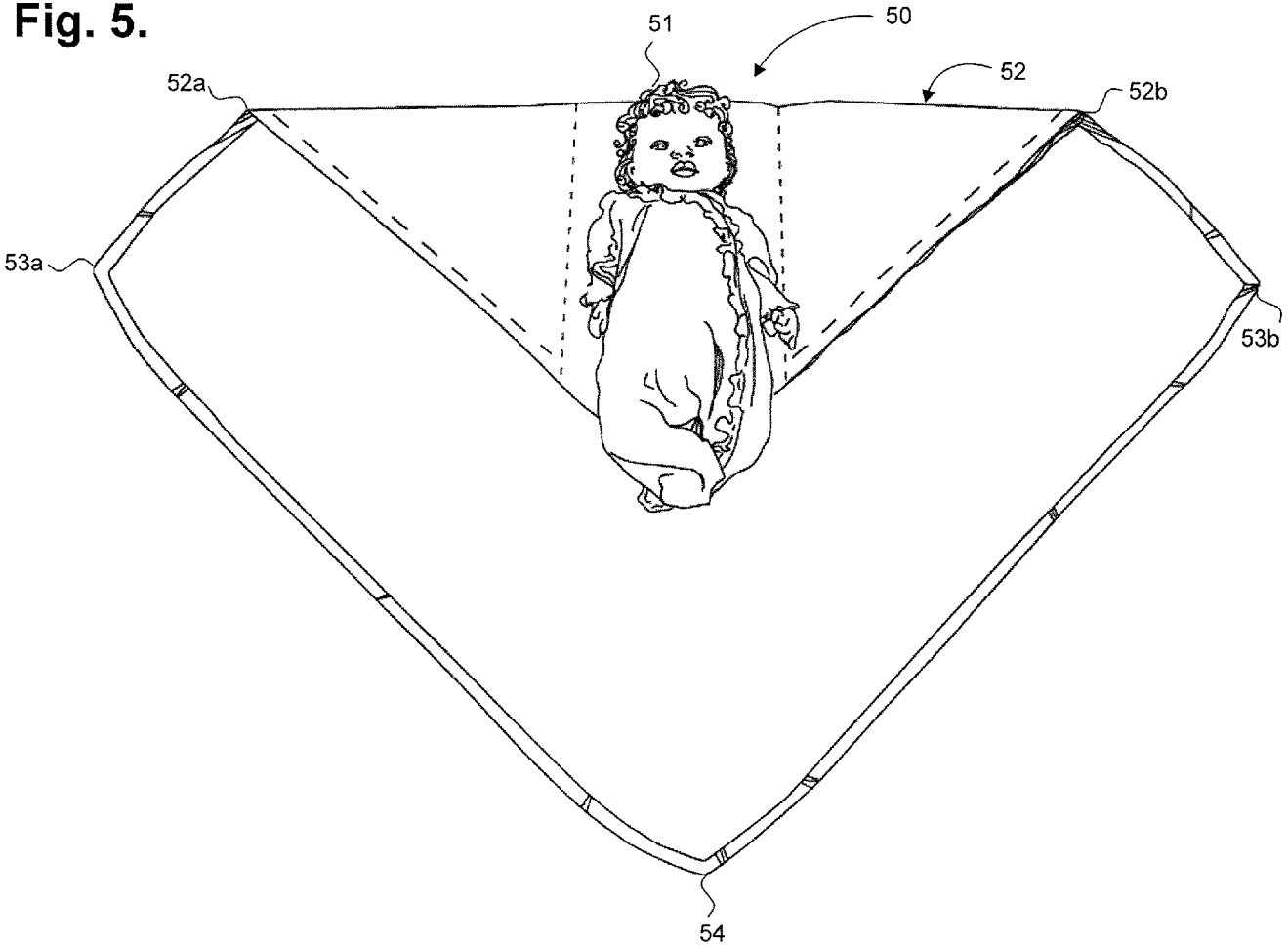
FIGS. 5-9 are functional block diagrams showing the supportive baby blanket of FIG. 1 as used with a baby.

Once assembled, the baby is placed on the supportive blanket. FIGS. 5-9 are functional block diagrams showing the supportive baby blanket 50 of FIG. 1 with a baby 51. As shown in FIG. 5, the supportive blanket 50 is positioned so that a straight edge 52 of the supportive blanket 50 represents a top end 52. Side corner ends 53*a-b* extend from each side 52*a-b* of the straight edge to form left 53*a* and right 53*b* corner edges, which end at a bottom corner edge 54 on a bottom end of the supportive blanket 50.

The baby 51 is positioned on top of the supportive blanket 50 above the support board (not shown) and sleeve (not shown), which are positioned within the pocket. The baby's head can rest on the support board near a top end of the cloth blanket, such that the baby's hips are also resting on the support board, as shown in FIG. 5. In one embodiment, if the support board is too short to support both the baby's head and hips, a longer support board should be used.

Figure 6:
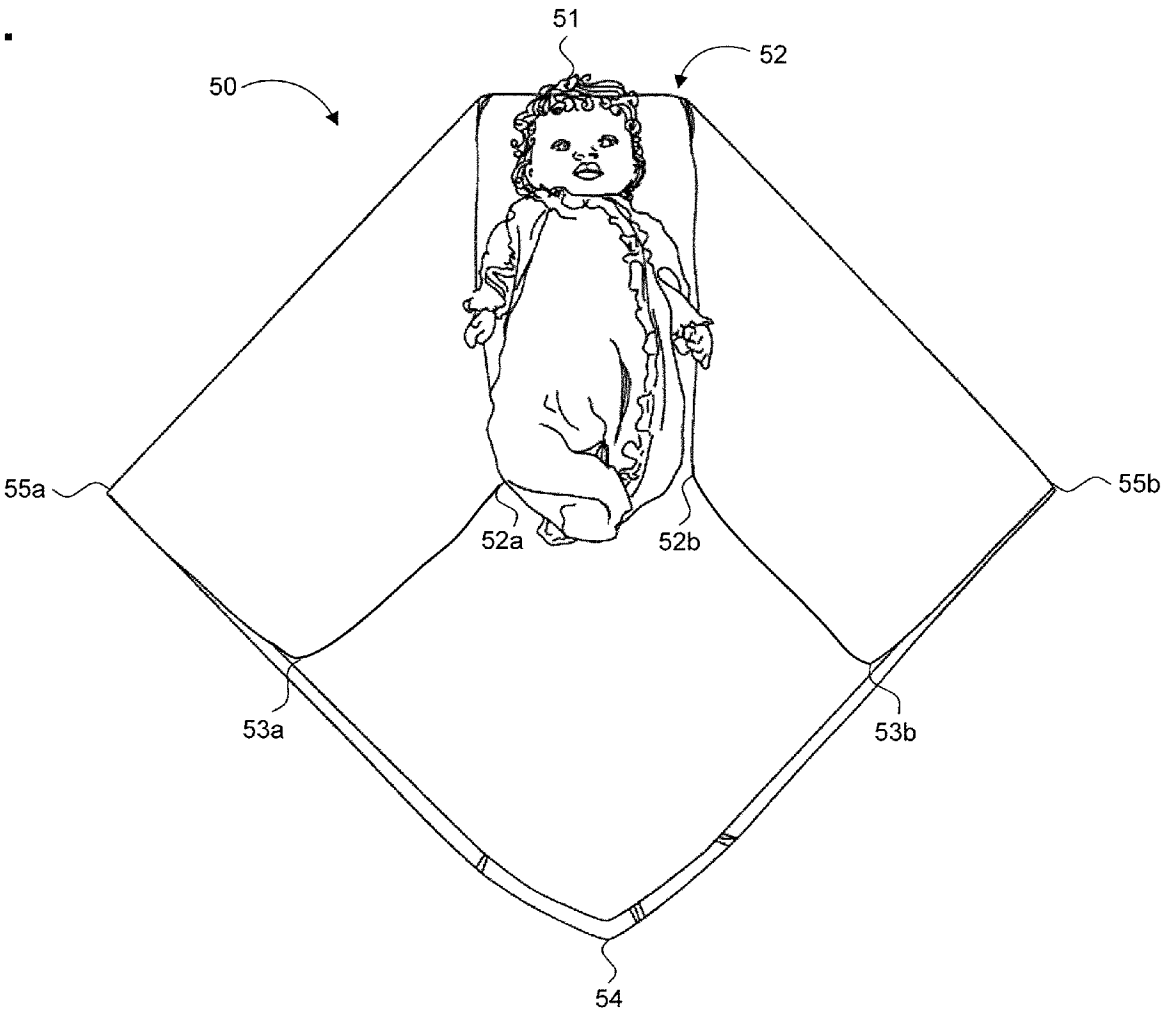

Once positioned, the baby 51 can be wrapped or swaddled in the supportive blanket 50. As shown in FIG. 6, each of the left and right corner edges 53*a-b* are folded downward towards the bottom end 54 of the supportive blanket 50 so that the end portions 52*a-b* of the top straight edge 52 are now placed along each side of the support board, which is positioned within a pocket of the supportive blanket 50. Once the sides 55*a-b* are folded downwards, a shape of the supportive blanket 50 loosely resembles a diamond with a smaller flat edge end 52 on a top end, newly folded left 55*a* and right 55*b* ends, and the bottom end 54.

Figure 7:
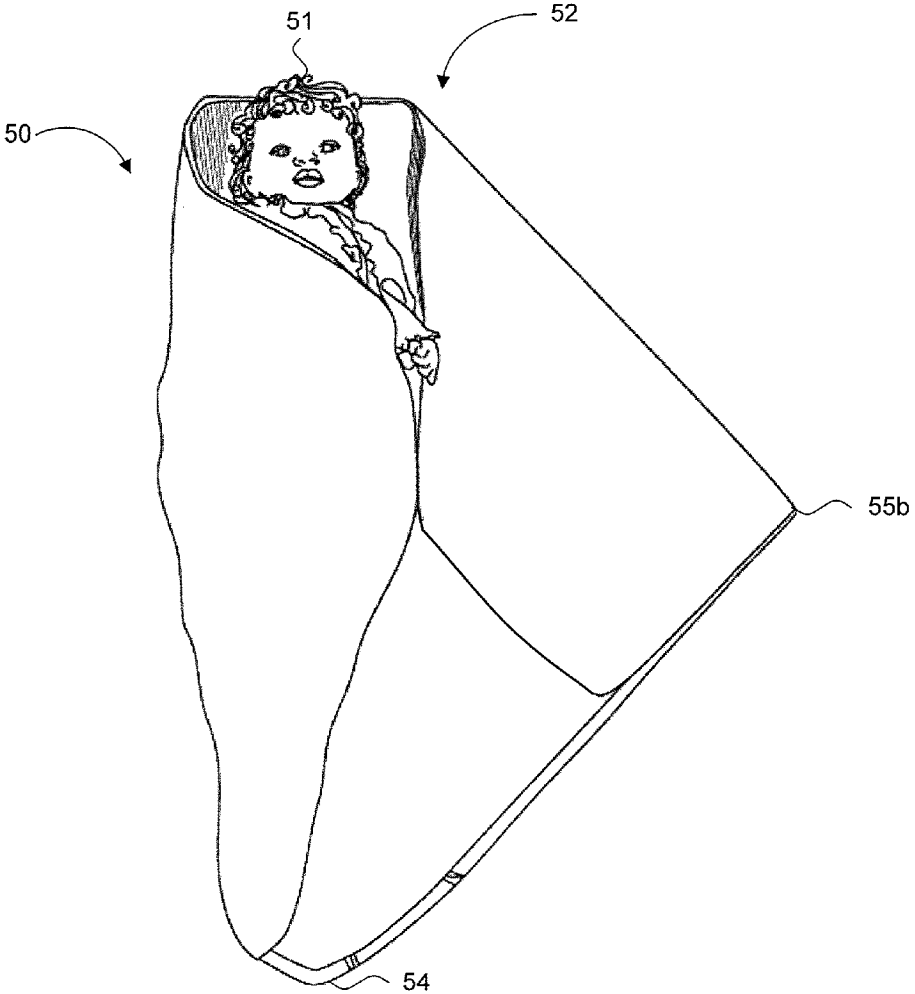
Figure 9:
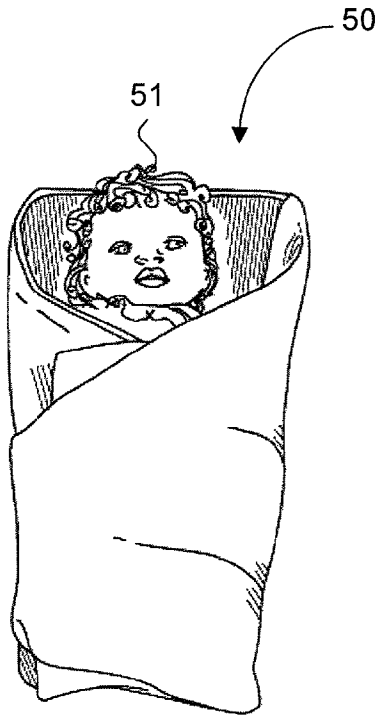
Figure 8:
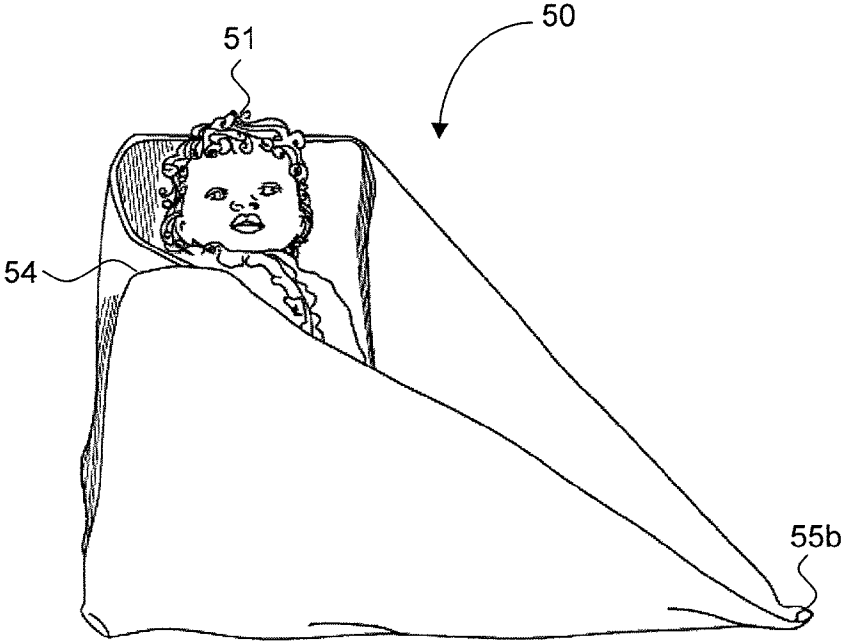

Next, one of the newly folded ends 55*a-b*, for example, the left side 55*a* is folded over and around the baby 51, as shown in FIG. 7. The bottom end 54 is then folded up towards the baby's chin, as shown in FIG. 8, and finally, the right side 55*b* is folded across the front of and around the baby 51, as shown in FIG. 9.

Figure 10:
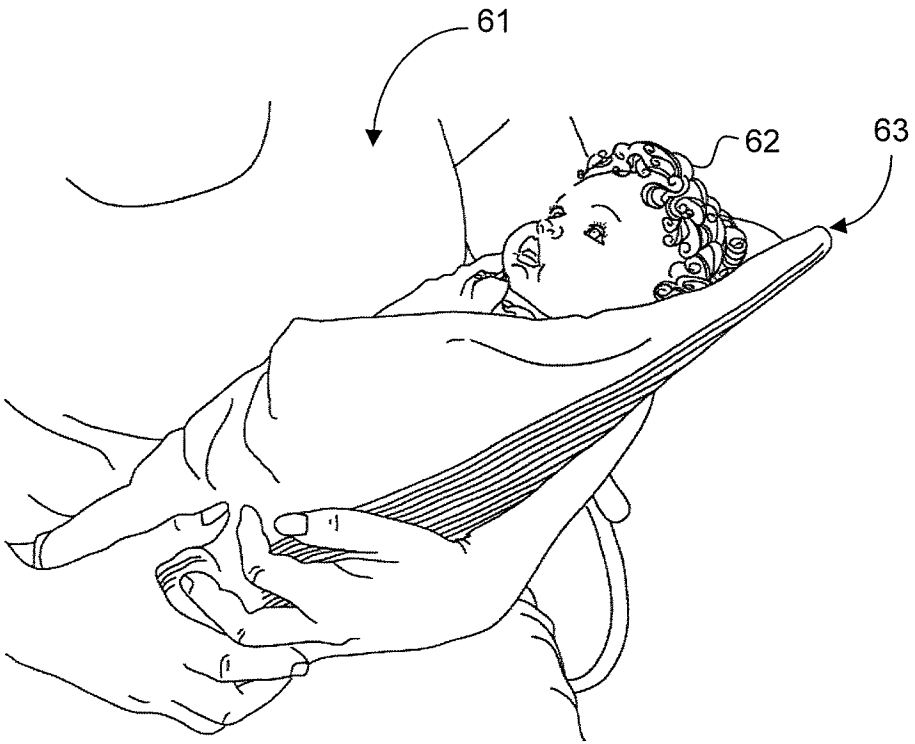
FIG. 10 is a functional block diagram showing an individual holding a baby in the supportive baby blanket of FIG. 1.

Once securely swaddled, an individual, such as a caregiver, can easily lift, carry, or pass the baby in the supportive blanket. FIG. 10 is a functional block diagram 60 showing an individual 61 holding a baby 62 in the supportive baby blanket 63 of FIG. 1. The supportive blanket 63 allows the individual 61 to easily support, carry, lift, and pass the baby 62 due to the added support provided by the blanket 63. The added support can further allow the individual to perform other tasks, such as preparing a bottle, attending other children and answering the phone or door, while still providing support to the baby. However, despite the added support provided by the support blanket, the individual must always ensure that the baby is carefully and fully supported, which can be performed by at least one of the individual's hands.

Additionally, the support blanket can be used to hold and support the baby in different positions, such as a football hold. The football hold requires an individual, such as the mother, to hold the baby on one side of the individual's body, for example, the right side. The baby is positioned with its head in the right hand of the individual, which is placed below the individual's right breast. The baby's back rests along the individual's right forearm with the baby's torso resting near the cubital fossa, also known as the "elbow pit" or "inside of the elbow." The baby's legs extend beyond the forearm and behind the individual. Often times, individuals, when using the football hold, are required to use a pillow or other mechanism on which to provide additional support the baby.

While the invention has been particularly shown and described as referenced to the embodiments thereof, those skilled in the art will understand that the foregoing and other changes in form and detail may be made therein without departing from the spirit and scope of the invention.

What is claimed is:

1. A supportive baby blanket, comprising:

a blanket comprising a square shape with at least one corner folded toward a center of the blanket forming a straight edge at the fold and affixed via two substantially parallel seams that each extend from an outer edge of the corner upward to the straight edge fold to form a pocket having a rectangular shape with an opening along a bottom side of the pocket located closest to the center of the blanket;

a support board comprising a firm material shaped to fit within the bottom opening of the pocket; and a padded sleeve independent of the blanket and shaped to conformably receive the support board through an opening on a bottom end prior to insertion into the pocket, wherein the sleeve comprises a flap formed on the bottom end that partially covers the opening of the padded sleeve.

2. A supportive baby blanket according to claim 1, wherein the support board is made from a material comprising at least one of plastic, polyurethane, and polyethylene.

3. A supportive baby blanket according to claim 1, wherein the padded sleeve is made from a material comprising a least one of cotton, felt, fleece, and microfiber.

4. A supportive baby blanket according to claim 1, wherein the blanket is made from a material comprising a least one of cotton, felt, fleece, and microfiber.

5. A supportive baby blanket according to claim 1, wherein a baby is positioned upon the support board and swaddled by the blanket.

6. A supportive baby blanket according to claim 1, wherein the support board is sized to provide support to one of a premature baby, a newborn baby, and an older baby.

7. A supportive baby blanket according to claim 1, wherein the support board comprises a substantially rectangular shape with rounded corners.

8. A supportive baby blanket according to claim 1, wherein the support board is sized to support a baby by extending from a top of a baby's head down past the baby's hips.

9. A method for constructing a supportive baby blanket, comprising:

forming a support board comprising a firm material having a substantially rectangular shape;

forming a sleeve sized to receive the support board via an opening formed on a bottom end, wherein the sleeve comprises a flap affixed to the bottom end that partially covers the opening of the sleeve; and providing independent of the sleeve, a blanket having a rectangular shape with a pocket, comprising:

forming a straight edge fold by folding one corner end of the blanket over a top surface of the blanket towards a center of the blanket;

affixing the corner end to the top surface via two parallel seams extending from straight edge sides of the corner end to the straight edge fold; and forming the pocket between the two parallel seams with a pocket opening located opposite the straight edge fold at the corner end near the center of the blanket, such that the pocket has a rectangular shape sized to receive the sleeve and support board.

10. A method according to claim 9, wherein the support board is made from a material comprising at least one of plastic, polyurethane, and polyethylene.

11. A method according to claim 9, wherein each of the sleeve and the blanket is made from a material comprising a least one of cotton, felt, fleece, and microfiber.

12. A method according to claim 9, wherein a baby is positioned upon the support board and swaddled by the blanket.

13. A method according to claim 9, wherein the support board is sized to provide support to one of a premature baby, a newborn baby, and an older baby.

14. A method according to claim 9, wherein the support board comprises a substantially rectangular shape with rounded corners.

15. A method according to claim 9, wherein the support board is sized to support a baby by extending from a top of the baby's head down past the baby's hips.

16. A method according to claim 9, further comprising:

inserting the support board into the sleeve; and inserting the support board and sleeve into the opening of the pocket.

* * * * *